US006554172B2

(12) United States Patent
Hohner et al.

(10) Patent No.: US 6,554,172 B2
(45) Date of Patent: Apr. 29, 2003

(54) STAPLE-FORMING APPARATUS

(75) Inventors: Claus-Otto Hohner, Tuttlingen (DE); Egbert Karrer, Allensbach (DE)

(73) Assignee: Hohner Maschinenbau GmbH, Tuttlingen (DE)

( * ) Notice: Subject to any disclaimer, the term of this patent is extended or adjusted under 35 U.S.C. 154(b) by 100 days.

(21) Appl. No.: 09/858,560

(22) Filed: May 17, 2001

(65) Prior Publication Data

US 2001/0042769 A1 Nov. 22, 2001

(30) Foreign Application Priority Data

May 18, 2000 (DE) ..... 100 24 113

(51) Int. Cl.[7] ..... B27F 7/30
(52) U.S. Cl. ..... 227/82; 227/89; 227/90
(58) Field of Search ..... 227/82, 88, 89, 227/90, 120, 156

(56) References Cited

U.S. PATENT DOCUMENTS

| | | | | | |
|---|---|---|---|---|---|
| 2,716,748 | A | * | 9/1955 | Sutton | 227/89 |
| 2,865,021 | A | * | 12/1958 | Marzili | 227/89 |
| 2,896,214 | A | * | 7/1959 | Wright | 227/89 |
| 5,516,024 | A | * | 5/1996 | Hohner et al. | 227/90 |

FOREIGN PATENT DOCUMENTS

| | | |
|---|---|---|
| DE | 44 44 220 | 7/1995 |

* cited by examiner

*Primary Examiner*—Scott A. Smith
(74) *Attorney, Agent, or Firm*—Breneman & Georges

(57) ABSTRACT

The invention proposes a staple-forming apparatus which is intended for stapling machines for forming staples and may be designed to be smaller than priorart apparatuses. This is achieved according to the invention in that a locking bar (9) for locking a pusher in the forming apparatus during the operation of forming the staple is fitted in a moveable manner in the pusher and a fixed stop (13) for the locking bar (9) is provided on the housing (2) of the staple-forming apparatus.

12 Claims, 3 Drawing Sheets

STAPLE-FORMING APPARATUS

BACKGROUND OF THE INVENTION (1) Field of the Invention

The invention relates to a staple-forming apparatus for stapling machines and stapling heads. More particularly the invention provides a stapler housing having a displaceable pusher that serves as a stop during the staple forming operation as well as an ejecting element during stapling and has a locking bar moveably fitted in the pusher with a fixed stop on the housing for the locking bar.

(2) Description of Related Art Including Information Disclosed Under 37 C.F.R. 1.97 and 1.98

In order to staple material which is to be stapled, such as paper, cardboard or the like, use is made, according to the prior art (DE 44 44 220), in stapling machines of so-called stapling heads which, in addition to other components, have staple-forming apparatuses. In these stapling apparatuses, which are also referred to as forming means, a cut-to-length piece of wire is bent into a u-shaped staple before being driven, by means of a staple driver, into the paper stack which is to be stapled.

The staple driver in this case is usually fitted in a moveable manner on a pusher in a forming-means housing. In order to form the staple, the forming-means housing has two side guides, in each of which is provided a groove for guiding the wire. The two end legs of the staple are formed in said side guides. The pusher itself comprises a driver which is positioned thereon and has an accommodating groove in a direction transverse to the movement direction, so that the crosspiece of the staple is formed between the two end legs. The entire forming means is actuated via a drive acting on the pusher.

In order to form the staple, a locking means is provided in the pushing direction of the pusher, with the result that the pusher, as it strikes against said locking-means, carries along the entire forming-means housing and pushes it onto the cut-to-length wire located transversely therebeneath. During this movement of the forming means, the wire positions itself on the side guides of the forming-means housing, on the one hand, and, transversely thereto, on the driver of the pusher, with the result that the u-shaped staple forms.

Once the staple has been formed, it is ejected in that the locking means of the pusher is released and the latter is pushed in the pushing direction. The pusher pushes the staple in this operating cycle, for example, into a paper stack located beneath the forming means. If appropriate, it is also possible to provide guide aids in order to prevent warping of the side legs of the staple during the pushing-in operation.

Conventional forming apparatuses comprise a locking bar which is mounted in a displaceable manner in the forming-means housing and engages in a curved path provided on the pusher. Formed in this curved path is a stop which, together with the locking bar fastened on the frame, defines the forming position of the pusher in the forming-means housing.

The object of the invention is to propose a type of construction for a forming apparatus for stapling machines which makes possible a smaller design of the forming means.

This object is achieved, taking as the departure point a prior art of the type mentioned in the introduction, by the utilization of a locking bar moveably fitted in the pusher with a fixed stop on the housing for the locking bar.

Advantageous refinements and developments of the invention are possible by way of the measures mentioned in the subclaims.

BRIEF SUMMARY OF THE INVENTION

Accordingly, a staple-forming apparatus according to the invention is distinguished in that a locking bar is fitted on the pusher such that it can be moved between a blocking position and a release position and a fixed mating stop for the locking bar is provided on the forming-means housing. Fitting the moveable locking bar on the pusher rather than, as in the case of the previously known prior art, on the forming-means housing then makes it possible to realize a locking means which has considerably reduced outer dimensions, since, up until now, it has been necessary for the guide of the transverse locking bar and the securing means thereof to be positioned to the housing of the forming means from the outside. According to the invention, now only a fixed mating stop, which does not take up any space, is required on the housing of the forming means since the actual locking bar is fitted on the pusher essentially in the interior of the forming means housing.

In a particularly advantageous embodiment of the invention, the locking bar is designed in the form of a pin which passes through the pusher in a direction transverse to the pushing direction. In addition to the locking bar being in a form which is particularly straightforward to produce and is easy to install, this ensures, at the same time, that the pusher is locked on both side guides in its blocking position, with the result that good force transmission can take place without tilting of the pusher.

In a development of this embodiment, a slot guide for the locking bar is provided in the housing of the forming means. This means that the locking bar is accessible from the outside in different positions of the pusher, which is advantageous, in particular, for installation and for actuation during the operation of the forming apparatus. The locking bar can be actuated, for example, by an actuating element acting directly on the locking bar.

It is also advantageous if the slot, in certain regions, has two different widths. This makes it possible, with the aid of a transverse displacement of the locking bar, for the blocking position to be locked and unlocked in a straightforward manner in that the locking bar has different diameters in certain regions. A larger diameter corresponds here to the larger width of the slot, while an axially offset, smaller diameter corresponds to the smaller width of the slot. Depending on the position of the locking bar, it is accordingly possible for the pin to pass through the narrow region of the slot or not. In the blocking position, the locking bar assumes a position by striking against the tapering of the slot by way of the larger diameter and thus being locked, while, in the release position, it can also be moved in the narrow region of the slot by way of the smaller diameter.

The slot advantageously has, at least in the region of its smaller width, a stepped formation in a direction transverse to the pushing direction of the pusher. This makes it possible for the displacement distance which is necessary for the unlocking and locking of the locking bar to be reduced. Furthermore, this design ensures that the locking bar essentially does not project beyond the outer contours of the forming means during operation and, in particular, during unlocking.

A restoring element, which pulls or pushes the locking bar into its locking position is preferably provided. This ensures automatic locking, with the result that actuation only has to take place for unlocking purposes. The restoring element may be designed, for example, in the form of a helical spring which is pushed onto the locking bar and butts against a stop on the locking bar, on the one hand, and a stop on the pusher, on the other hand. In this configuration, the locking bar is always pushed in its axial direction, i.e. in a direction transverse to the actuating direction of the pusher, in one direction by means of the helical spring.

A blocking member is preferably provided, it being possible for said blocking member to be fitted on the locking bar by means of a rotary closure. Such a blocking member makes it possible, for installation purposes, for the locking bar, with the helical spring positioned, to be pushed into the pusher from one side until it projects on the opposite side. It is then possible, on this opposite side, for a larger-diameter blocking member to be positioned and fastened by means of the rotary closure. This arrests the locking bar in the corresponding cutout of the pusher and/or of the forming means.

It is also advantageous if the blocking member has a rotation-prevention means. This ensures that the rotary closure of the blocking member on the locking bar is not released automatically during the operation of the apparatus.

In the same way, it is advantageous if, in addition, a rotation-prevention means is provided on the locking bar in order to prevent rotation of the pin relative to the blocking member, with the result that unintended release of the blocking member by rotation of the pin is likewise ruled out.

BRIEF DESCRIPTION OF THE SEVERAL VIEWS OF THE DRAWINGS

An exemplary embodiment of the invention is explained in more detail hereinbelow with reference to the figures and is illustrated in the drawing, in which, specifically.

DETAILED DESCRIPTION OF THE INVENTION INCLUDING BEST MODE

Figure 1:
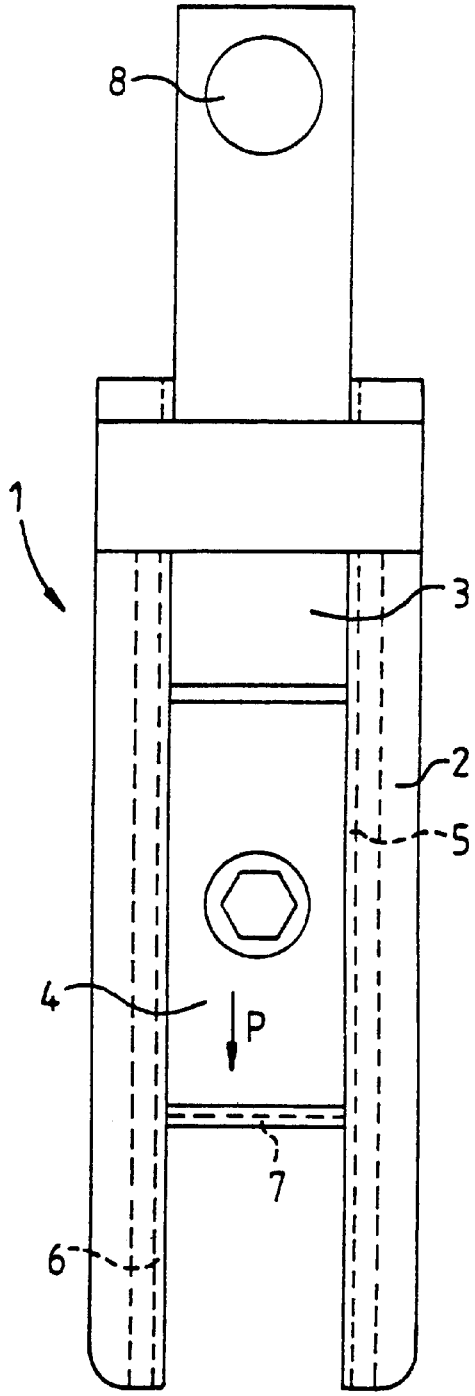
FIG. 1 shows a plan view of a forming means according to the invention with the pusher inserted.

The forming means 1 according to FIG. 1, comprises a housing 2 in which a pusher 3 is mounted in a displaceable manner. Screwed on the pusher 3 for this purpose is a driver 4 which is guided laterally in lateral grooves 5, 6 of the housing 2 by corresponding springs (not illustrated specifically). On the underside, the driver 4 is provided with a transverse groove 7 which, together with the lateral grooves 5, 6 serves for forming a unshaped staple. At its top end, the pusher 3 has a bore 8 on which a lifting mechanism can be fastened.

Figure 2:
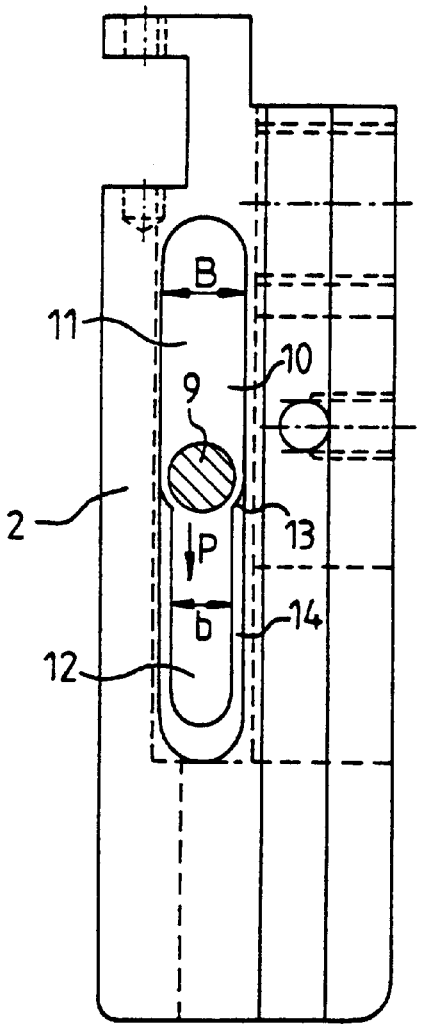
FIG. 2 shows a side view of the forming means according to FIG. 1.

A transversely lying locking bar 9 which is not illustrated in FIG. 1 (see FIG. 2) is guided in two slots 10 on both sides of the frame 2 and passes through the pusher 3 in a manner which will be explained below. The slot 10 comprises a section 11 of larger width B and a section 12 of smaller width b. The smaller width b is produced by a tapering 13 which is present in the transition region between the two sections 11 and 12. The tapering 13 and the slot section 12 of smaller width b are provided with a stepped formation 14, of which the functioning will be explained in more detail with reference to FIGS. 3 and 4. FIG. 2 clearly shows that, when the pusher 3 is pushed in the direction of the arrow P, the pin-like locking bar 9 can strike, in its blocking position, against the tapering 13.

Figure 3:
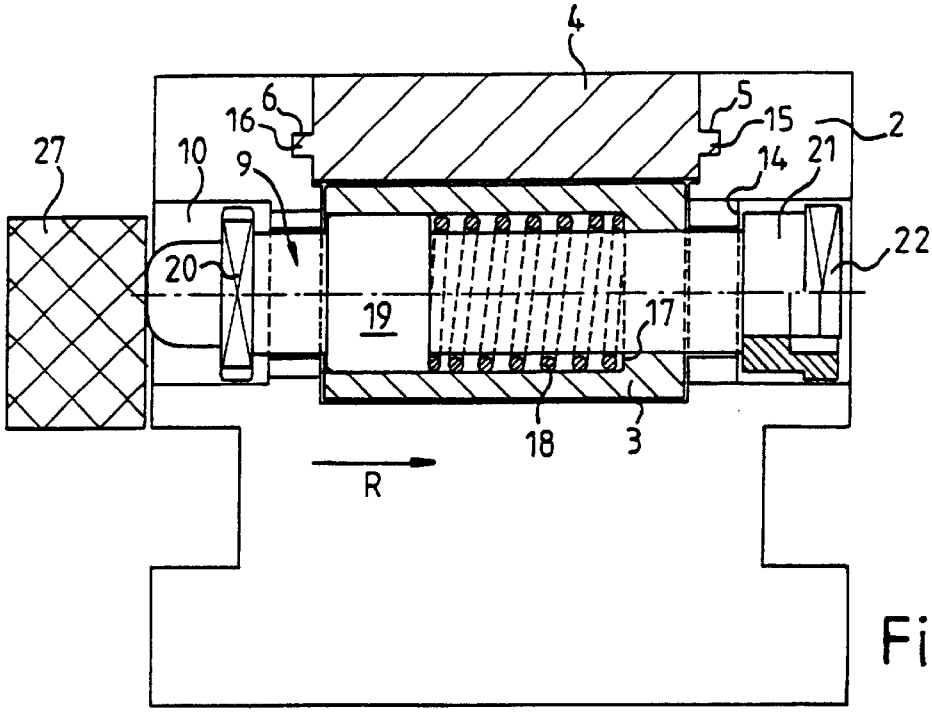
FIG. 3 shows a schematic sectional illustration through the forming means in the release position of the blocking means.

The schematic cross section according to FIG. 3 illustrates the locking bar 9 passing through the housing 2 and the pusher 3. This figure also clearly shows the driver 4 which is positioned on the pusher 3 and is guided in the side grooves 5, 6 by way of corresponding springs 15, 16.

It can also be seen that a stop 17, on which a helical spring 18 rests, is formed in the interior of the pusher 3. At the opposite end, the helical spring 18 strikes against an annular protrusion 19 on the locking bar 9, which serves as a mating stop.

On one side, the locking bar 9 is provided with a square protrusion 20 which ensures that the locking bar 9 cannot rotate in the slot 10. On the opposite side, a blocking member 21 is likewise provided with a square protrusion 22, which secures the blocking member 21 against rotation in the associated slot.

Figure 5:
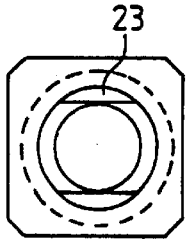
FIG. 5 shows a plan view of a blocking member of a locking bar.
Figure 6:
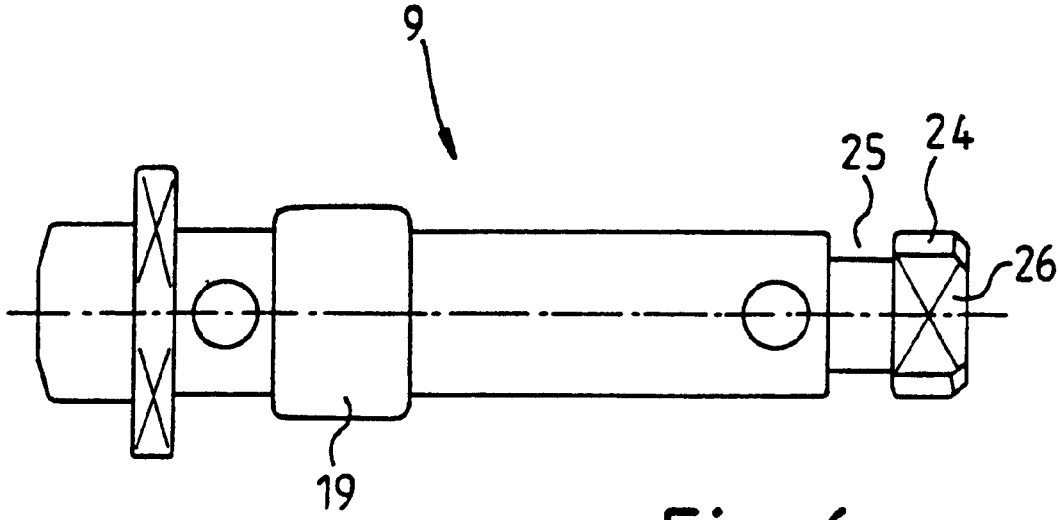
FIG. 6 shows a plan view of a locking bar.
Figure 7:
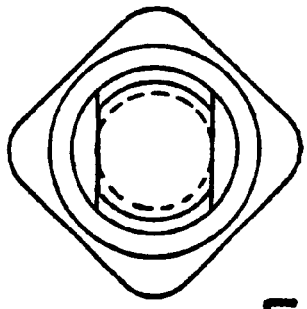
FIG. 7 shows an end view of a locking bar according to FIG. 6.

The blocking member 21 comprises a bore 23 (see FIG. 5) into which crosspieces (not illustrated specifically) project on both sides, radial continuations 24 of the locking bar 9 coming to rest on said crosspieces in the installed state. The continuations 24 are produced by a groove 25 being introduced into the locking bar 9 and subsequent flattening on two opposite sides of the locking bar 9 to give two surfaces 26 which are spaced apart such that they fit between said crosspieces of the blocking member 21. It is thus possible for the blocking member 21 to be plugged on at a certain angle and fixed by subsequently being rotated through 90'. This type of fastening corresponds to a so-called bayonet closure. However, other types of closure, e.g. a screw-connection, would likewise be conceivable.

Figure 4:
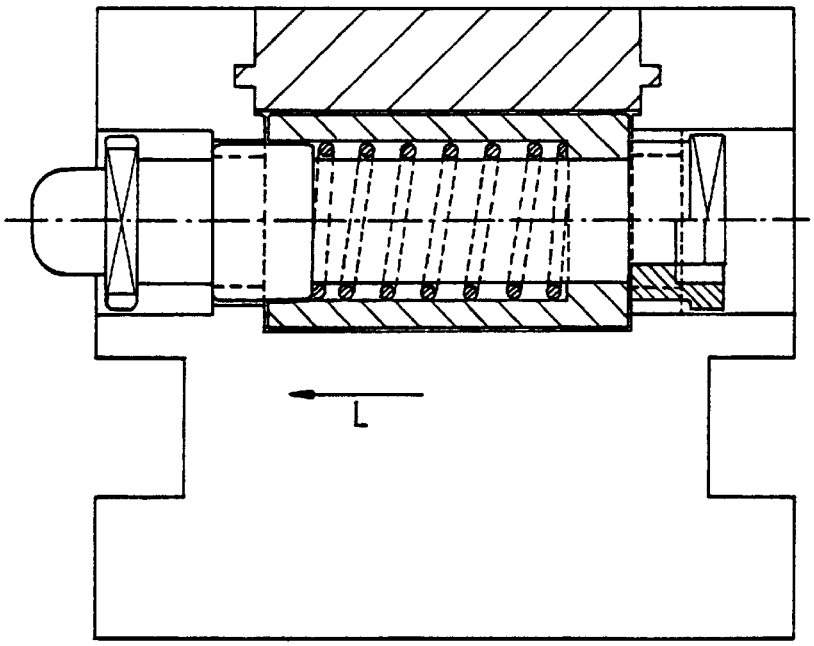
FIG. 4 shows an illustration of the forming means according to FIG. 3 in the blocking position.

The locking bar 9 is installed by the helical spring 18 being plugged on and then by this assembly being plugged into the forming-means housing and the pusher 3 from one side (from left to right in the illustrations according to FIGS. 3 and 4). When the locking bar 9 has been pushed in to the full extent, its opposite end projects from the housing 2 to such an extent that the blocking member 21 can be positioned and rotated. Once the locking bar 9 has slipped back, and thus when the blocking member 21 engages in the corresponding slot in the frame 2, the blocking member 21, on account of the square protrusion 22, is secured against rotation in the same way as the locking bar 9 is secured by the square protrusion 20. In this state, the locking bar 9 is retained in captive fashion in the housing 2 and/or in the pusher 3.

The blocking position (see FIGS. 1 and 4), is brought about by the helical spring 18, in which the locking bar 9 is pressed to the left in the direction of the arrow L. In this case, the annular protrusion 19 is located in the section 11 of the slot 10 with larger width B. On the opposite side, the blocking member 21, accordingly, is likewise in the corresponding slot section with larger width B. Upon displacement of the pusher 3 in the pushing direction P, the locking bar 9 strikes against the taperings 13 on both sides by way of the annular protrusion 19, on the one hand, and by way of the blocking member 21, on the other hand, and is thus blocked against further displacement.

In order to release the locking, the locking bar 9 is pushed, counter to the pressure of the helical spring 18, in the direction R (see FIG. 3) by an actuating element 27, which is indicated, of a stapling head (not illustrated). As a result, the annular protrusion 19 is pushed into the interior of the pusher 3, with the result that the locking bar 9, by way of its narrower diameter, can pass into the section 12 of the slot 10 with smaller width B. On the other side, the blocking member 21 is pushed out beyond the stepped formation 14, with the result that, on this side too, the locking bar 9 can pass into the slot section with smaller width B. The width of this stepped formation 14 thus provides the distance, which is necessary for locking release, by which the locking bar 9 has to be displaced. In this release position, the pusher 3 can be pushed downward in the direction of the arrow P at least to the bottom edge of the housing 2.

The forming means functions as follows. The forming means 1 is positioned on a prepared, cut-to-length piece of wire which is located on an abutment the width of which corresponds to the distance between the two bottom side guides of the forming-means housing 1 and thus essentially also to the width of the pusher 3. When the forming means 1 is pushed down, the wire prepared in this way is bent over until it comes to rest in the grooves 6 of the side guides and in the transverse groove 7 of the driver 4 of the pusher 3. A u-shaped staple is thus formed. Since the displacement of the forming means 1 is applied via the pusher 3, it is necessary to lock the pusher in the housing 2 in the manner described above in order that, rather than the pusher 3 sliding through to the bottom edge of the forming means 1, the pressure is transmitted to the forming-means housing 2 via the locking bar 9.

Once the staple has been formed, the staple located in the grooves 6, 7 is pushed, by means of the pusher 3, into the material which is to be stapled, e.g. into a paper stack, which, for this operation, is arranged beneath the forming means 1. For this purpose, the release position according to FIG. 3 can be brought about by actuation of the locking bar 9, with the result that the pusher 3 can be pushed down with its driver 4 fully in the direction of the arrow P to the bottom edge of the forming-means housing 2 once the forming-means housing 2 has been positioned on the paper stack. During this operation, the staple located in the grooves 6, 7 is pushed into the material which is to be stapled.

The length of the section 11 of the slot 10 with larger width B constitutes a length-compensation means, with the result that it is possible to use the forming means 1 in machines with different displacements for the forming means 1.

The locking in order to produce a blocking position for the slide 3 has been effected, up until now, by a corresponding curved path being formed into the pusher 3 and a locking bar positioned on the housing 2 being provided. The locking method now proposed according to the invention, in which the locking bar 9 is integrated in the pusher and only a fixed stop 13 is provided on the housing 2, makes considerably smaller dimensions of the forming means 1 possible.

List of designations:

1 Forming means
2 Housing
3 Pusher
4 Driver
5 Groove
6 Groove
7 Transverse groove
8 Bore
9 Locking bar
10 Slot
11 Section
12 Section
13 Tapering
14 Stepped formation
15 Spring
16 Spring
17 Stop
18 Helical spring
19 Annular protrusion
20 Square protrusion
21 Blocking member
22 Square protrusion
23 Bore
24 Continuation
25 Groove
26 Surface
27 Actuating element

What is claimed is:

1. Staple-forming apparatus for stapling machines for forming staples in stapling heads, having a housing in which a pusher is mounted in a displaceable manner, said pusher serving, at the same time, as a stop during the staple-forming operation and as an ejecting element during stapling of material which is to be stapled, such as paper, cardboard or the like, and a means which locks the pusher in relation to the housing being provided, wherein the improvement comprises a locking bar fitted in a moveable manner in the pusher (3) and a fixed stop (13) for the locking bar (9) is provided on the housing (2) of the staple-forming apparatus (1).

2. Apparatus according to claim 1, wherein said locking bar (9) is a pin which passes through the pusher (3) in a direction transverse to the pushing direction P.

3. Apparatus according to claims 1 or 2 further comprising a slot guide (10) for the locking bar (9) is disposed in the housing (2).

4. Apparatus according to claim 3 wherein said slot guide (10) has at least two sections (11, 13) of different widths.

5. Apparatus according to claim 3 wherein said slot guide (10) has a stepped formation (14) at least in certain regions.

6. Apparatus according to claims 1 or 2 wherein said locking bar (9) has at least two sections with different diameters.

7. Apparatus according to claims 1 or 2 further comprising a restoring element (18).

8. Apparatus according to claim 7 wherein said restoring element is a helical spring (18) disposed between a stop (19) on the locking bar and a stop (17) on the pusher.

9. Apparatus according to claims 1 or 2 further comprising a blocking member (21) fastenable on said locking bar (9) by a rotary closure.

10. Apparatus according to claim 9 wherein said blocking member (21) has a rotation-prevention means.

11. Apparatus according to claim 10 wherein said rotation-prevention means is provided on the locking bar (9).

12. A staple forming machine comprising:

(a) a housing having a staple guide;

(b) a pusher displaceably disposed in said staple guide;

(c) a locking bar moveably disposed in said pusher; and (d) a fixed stop locking said locking bar in a fixed position with respect to said housing.

* * * * *